US011421696B2

(12) United States Patent
Lissoni et al.

(10) Patent No.: US 11,421,696 B2
(45) Date of Patent: Aug. 23, 2022

(54) MULTI-STAGE COMPRESSOR WITH SINGLE ELECTRIC DIRECT DRIVE MOTOR

(71) Applicant: INGERSOLL-RAND INDUSTRIAL U.S., INC., Davidson, NC (US)

(72) Inventors: Cristiano Lissoni, Inzago (IT); Juha Tuomas Saari, Espoo (FI); Jouko Tapani Peussa, Brussels (BE)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 903 days.

(21) Appl. No.: 14/974,715

(22) Filed: Dec. 18, 2015

(65) Prior Publication Data

US 2016/0186764 A1 Jun. 30, 2016

Related U.S. Application Data

(60) Provisional application No. 62/098,465, filed on Dec. 31, 2014.

(51) Int. Cl.

| | |
|---|---|
| ***F04D 25/06*** | (2006.01) |
| ***F04D 17/12*** | (2006.01) |
| ***F04D 17/10*** | (2006.01) |

(52) U.S. Cl.

CPC ..... *F04D 25/06* (2013.01); *F04D 17/105* (2013.01); *F04D 17/12* (2013.01); *F04D 17/122* (2013.01); *F04D 25/0606* (2013.01)

(58) Field of Classification Search

CPC ..... F04D 17/06; F04D 17/08; F04D 17/10; F04D 17/105; F04D 17/12; F04D 17/122; F04D 25/02; F04D 25/06; F04D 25/062; F04D 25/0606; F04D 29/046; F04D 29/048; F04D 29/056; F04D 29/058

See application file for complete search history.

(56) References Cited

U.S. PATENT DOCUMENTS

| | | | | |
|---|---|---|---|---|
| 2,819,836 | A * | 1/1958 | Eberle | F04D 29/5846 415/144 |
| 4,224,010 | A * | 9/1980 | Fujino | F04D 17/122 415/199.2 |
| 5,980,218 | A | 11/1999 | Takahashi et al. | |
| 6,111,333 | A * | 8/2000 | Takahashi | F16C 32/0489 310/68 B |
| 6,464,469 | B1 | 10/2002 | Grob et al. | |
| 7,044,716 | B2 | 5/2006 | Fabry | |
| 7,144,226 | B2 | 12/2006 | Pugnet et al. | |
| 7,575,422 | B2 | 8/2009 | Bode et al. | |

(Continued)

FOREIGN PATENT DOCUMENTS

| | | |
|---|---|---|
| EP | 1217219 A2 | 6/2002 |
| EP | 2384399 B1 | 2/2013 |

*Primary Examiner* — Dominick L Plakkoottam
*Assistant Examiner* — Charles W Nichols
(74) *Attorney, Agent, or Firm* — Kevin E. West; Advent, LLP

(57) ABSTRACT

A compressor system includes an electric motor having a rotatable output shaft extending from either end thereof. The compressor system further includes multiple compression stages fluidly coupled to one another in series and mechanically connected to the output shaft. The first compressor stage includes two split impellers with each impeller discharging approximately one half of the fluid flow at a desired pressure to the second compressor stage.

24 Claims, 4 Drawing Sheets

(56) References Cited

U.S. PATENT DOCUMENTS

| | | | | |
|---|---|---|---|---|
| 8,040,007 | B2 | 10/2011 | Petrov et al. | |
| 2005/0188765 | A1* | 9/2005 | Care | F01D 5/027 73/460 |
| 2011/0008186 | A1* | 1/2011 | Palomba | F04D 17/122 417/247 |
| 2011/0038737 | A1* | 2/2011 | Conry | F04D 17/14 417/53 |
| 2012/0087810 | A1 | 4/2012 | Peussa | |
| 2012/0107143 | A1 | 5/2012 | Gilarranz et al. | |

* cited by examiner

MULTI-STAGE COMPRESSOR WITH SINGLE ELECTRIC DIRECT DRIVE MOTOR

CROSS REFERENCE TO RELATED APPLICATIONS

This application claims the benefit of U.S. Provisional Application No. 62/098,465, filed Dec. 31, 2014, which is incorporated herein by reference in its entirety.

TECHNICAL FIELD

The present application generally relates to industrial air compressor systems and more particularly, but not exclusively to a multi-stage compressor system driven by a single high speed direct drive electric motor.

BACKGROUND

Industrial compressor systems that include multiple compressors are configured to produce pressurized fluid such as compressed air or the like. Typically multistage compressor systems either require multiple motive sources and/or one or more gears or gear boxes to deliver rotational torque to the multiple stages of compressors. Some existing systems have various shortcomings due to the increased number of components, increased system complexity and increased cost relative to the novel system disclosed herein. Accordingly, there remains a need for further contributions in this area of technology.

SUMMARY

One embodiment of the present invention is a unique multi-stage compressor system driven by a single high speed direct drive electric motor. Other embodiments include apparatuses, systems, devices, hardware, methods, and combinations for compressor systems with a unique multi-stage compressor system. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
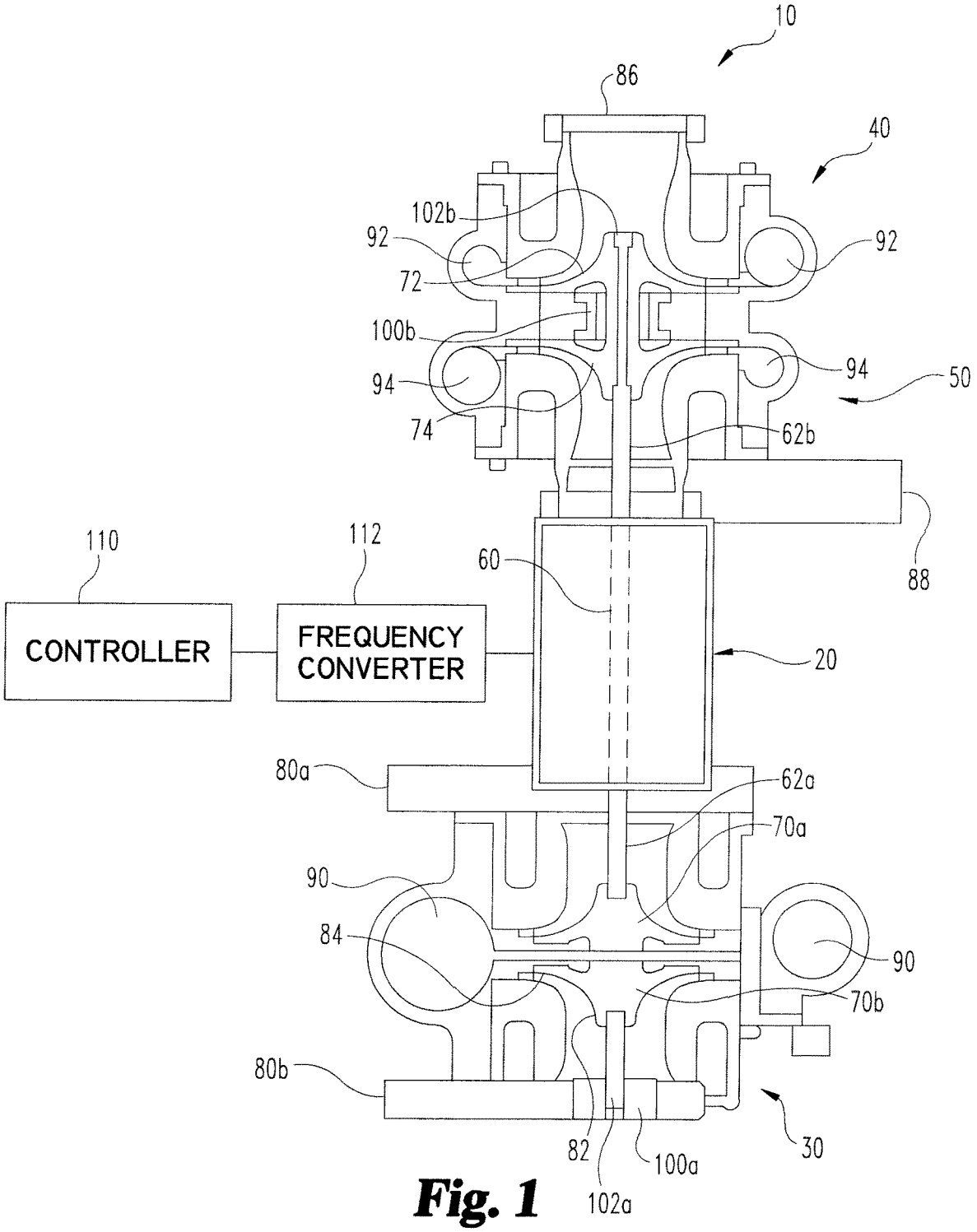
FIG. 1 is a cross-sectional view of a compressor system according to one embodiment of the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

The present application is directed to a multi-stage compressor that is more compact and efficient relative to other known compressor systems. The novel system disclosed herein includes a single high speed electric motor directly coupled to the multiple stages of compressors. It should be noted that when the term multi-stage is used herein, that it connotes two or more compressor stages that are in fluid communication in a serial fashion; e.g. the downstream compressor further compresses fluid received from the upstream compressor. Also, it should be understood that while three compressor stages are illustrated in the disclosed embodiments, that four or more compressor stages are contemplated within the teachings herein. In one form the compressors are of the centrifugal type whereby a bladed impeller compresses a fluid through high speed rotation that forces the fluid to move radially outward from an inlet to the outer diameter of the impeller. The compressed fluid then flows through a diffuser to decrease the flow velocity and convert dynamic pressure to static pressure. The compressed fluid is then then collected and transported through a volute to a downstream location that can include heat exchange coolers and additional compressor stages. In some embodiments interstage coolers and/or aftercoolers need not be utilized with some or all of the compressor stages. In one form, the compressible fluid includes air, however the present disclosure should not be limited to any particular type of fluid or mixture of fluids as any suitable fluid can be used as a working fluid in the systems described herein.

Compressor systems of up to one megawatt power or greater can be powered with a high speed electric motor having output shaft speeds in the range of 30,000 rpm or greater. A compressor system may have compressor stages that operate at peak efficiency at different rotation speeds relative to one another. The variations in efficiency occur in part due to variations in fluid dynamic properties of the fluid entering the compressors. Such fluid dynamic properties include pressure, temperature and mass flow rate.

A gear train system is required to drive multiple stages of compressors at different speeds when the motive source is a single electric motor. The efficiency of the overall compressor system can be increased and system costs can be reduced if gear train systems can be eliminated, however the individual stage efficiency of some of the compressor stages will necessarily operate below a peak efficiency.

Compressor stage efficiency is a function of specific speed. Specific speed is a non-dimensional number defined by the equation $N_s=N*\sqrt{Q}/(H^{0.75})$ where N is actual rotational speed in rpm, Q is volumetric flow rate in cubic feet per second, and H is torque ($ft*Ib_f$) per pound mass ($Ib_m$) of flow. Volumetric flow to each subsequent compression stage changes due to increased pressure and temperature, therefore the specific speed for each of the stages will vary which leads to a reduction in compressor stage efficiency for off design speeds. In order to minimize the compressor stage efficiency losses due to operating multiple compressor stages at the same actual rotational speed, the present disclosure proposes to split the first stage compressor into two separate impellers. By splitting the first stage compressor with two impellers, each of the first stage impellers can receive and compress approximately one half of the total fluid flow subsequently delivered to the second stage compressor. In this manner, the second stage impeller can be operated at a desired specific speed to maximize the second stage efficiency and the first compression stage can be operated much closer to an ideal specific speed due to the split impeller arrangement. The third stage impeller can also achieve a good efficiency because the actual speed of the high speed motor is set to maximize the efficiency of the second stage impeller which is typically much closer to the ideal efficiency of a third stage compressor.

Further system efficiency improvements can be obtained with the teachings of the present disclosure because a single frequency convertor can be used to control the single high speed electric motor, whereas systems with multiple electric motors require a corresponding number of frequency convertors. A single frequency convertor can, in conjunction with an electronic controller, control the speed of the high speed electric motor to maximize the efficiency of the overall compressor system.

In addition, active magnetic bearings can be used in lieu of standard hydrodynamic oil bearing systems. Active magnetic bearings can be more efficient than hydrodynamic bearings because there are no frictional losses through fluid dynamic interaction with rotating components as is the case with hydrodynamic bearings. Active magnetic bearings also do not suffer from wear, and can often accommodate irregularities in the mass distribution automatically, allowing rotors to spin around their center of mass with very low vibration.

An active magnetic bearing works on the principle of electromagnetic suspension and includes an electromagnet assembly, a set of power amplifiers which supply current to the electromagnets, a controller, and gap sensors having associated electronics to provide the feedback required to control the position of the rotor within the gap. The power amplifier supplies equal bias current to two pairs of electromagnets on opposite sides of a rotor. The rotor shaft position variation is monitored and controlled by the electronic controller, which offsets the bias current by equal and opposite perturbations of current as the rotor deviates from a centered position. The gap sensors can be inductive in nature to sense gap spacing in a differential mode and are operable to send the sensed gap measurement to the controller for real time control. Active magnetic bearings measure the rotor vibration and absolute position at a high frequency that can exceed 20,000 times per second in some applications. The measured data can be used to monitor the health of the rotor systems and provide a basis for real time active control of the rotor system.

The high speed electric motor can be of any type known such as by way of example and not limitation, a solid steel rotor induction motor or a permanent magnet motor. In some forms, the operation range of the motor will fall above the first bending critical speed and the rotor will be supercritical. The active magnetic bearing control system can sense and control vibrations that occur due to operation at a natural frequency of the compressor system without relying on additional vibration sensors for the disclosed system.

Referring now to FIG. 1, a compressor system 10 is illustrated in schematic cross sectional form. The compressor system 10 includes a single high speed electric motor 20 operable for directly driving at least three compressor stages without the aid of an intermediate gear drive train. In one embodiment, a first compressor stage 30 can be positioned on one side of the electric motor 20 and the second and third stages 40, 50 respectively can be positioned on the other side of the electric motor 20. In alternate forms, all of the compressors can be positioned on one side of the electric motor 20. In other embodiments, four or more compressors may be directly driven by the high speed motor 20. A single shaft 60 is directly connected to each of the compressor stages 30, 40, 50 such that all are driven at the same speed. A first end of the shaft 62*a* can be directly coupled to the first stage compressor 30 and a second end 62*b* of the shaft 60 can be connected to the second stage compressor 40 and the third stage compressor 50.

In one embodiment one or more of the compressor stages can include a split impeller arrangement. As illustrated, the first stage compressor 30, for example can include a dual or split impeller arrangement such that a first impeller 70*a* can be positioned back to back with a second split impeller 70*b*. In this configuration, each impeller 70*a*, 70*b* receives approximately one half of the fluid to be compressed at the first stage as required to match the flow and speed requirements of the compressor stages downstream of the first stage compressor 30. A first fluid inlet 80*a* can direct a fluid such as ambient air into the first split impeller 70*a* and a second fluid inlet 80*b* can direct ambient air into the second impeller 70*b*. The second stage compressor 40 includes a single second stage impeller 72 and the third stage compressor 50 includes a single third stage impeller 74. The impellers illustrated in the present disclosure are of the centrifugal type however, other forms are contemplated such as for example axial flow compressors.

Centrifugal compressors are designed to compress air as the air flows from the hub 82 and accelerates to the tip 84 as illustrated on the second split impeller 72*b* of the first stage compressor 30. Compressed flow will be directed from the tip of an upstream impeller to the hub of a downstream impeller in a serially staged configuration as will be described in more detail below. A third inlet 86 is operable for receiving compressed air from the first stage compressor and directing the air into the second stage compressor 40. Similarly, a fourth inlet 88 receives the compressed air discharged from the second stage compressor 40 and directs the compressed air into the third stage compressor 50 for a final compression operation.

The first stage compressor 30 includes an outlet volute 90 that collects compressed air exiting the tips of the impellers 70*a*, 70*b* and directs the compressed air flow from the first stage compressor 30 into an outlet conduit (not shown in FIG. 1) and then optionally to one or more coolers sometimes called intercoolers or aftercoolers (not shown in FIG. 1). The second stage compressor 40 includes an outlet volute 92 that directs compressed air from the second stage compressor 30 to an outlet conduit (not shown) and optionally to one or more aftercoolers (not shown). The third stage compressor 50 also includes an outlet volute 94 that directs compressed air from the third stage impeller 74 to an outlet conduit and alternatively to one or more aftercoolers and then to a compressed air holding tank or an end use machine.

One or more sets of electromagnetic or active magnetic bearings can be used in some embodiments of the present application. For example, a first magnetic bearing 100*a* can rotatably support a shaft 102*a* extending from the first compressor stage and a second magnetic bearing 100*b* can rotatably support a shaft 102*b* extending between the second and third stage compressors 40, 50 respectively. Other configurations for the active magnetic bearing can be implemented in alternate embodiments as will be explained herein.

An electronic controller 110 can be used to provide control signals directly to the electric motor 20 so that the desired speed for efficient compressor operation or a desired compressed air flow rate can be output according to user requirements. A single frequency converter 112 can be operably coupled to the controller and to the electric motor so as to convert an electrical power source into the desired frequency for efficient operation of the electric motor 20 and the compressor system 10.

Figure 2:
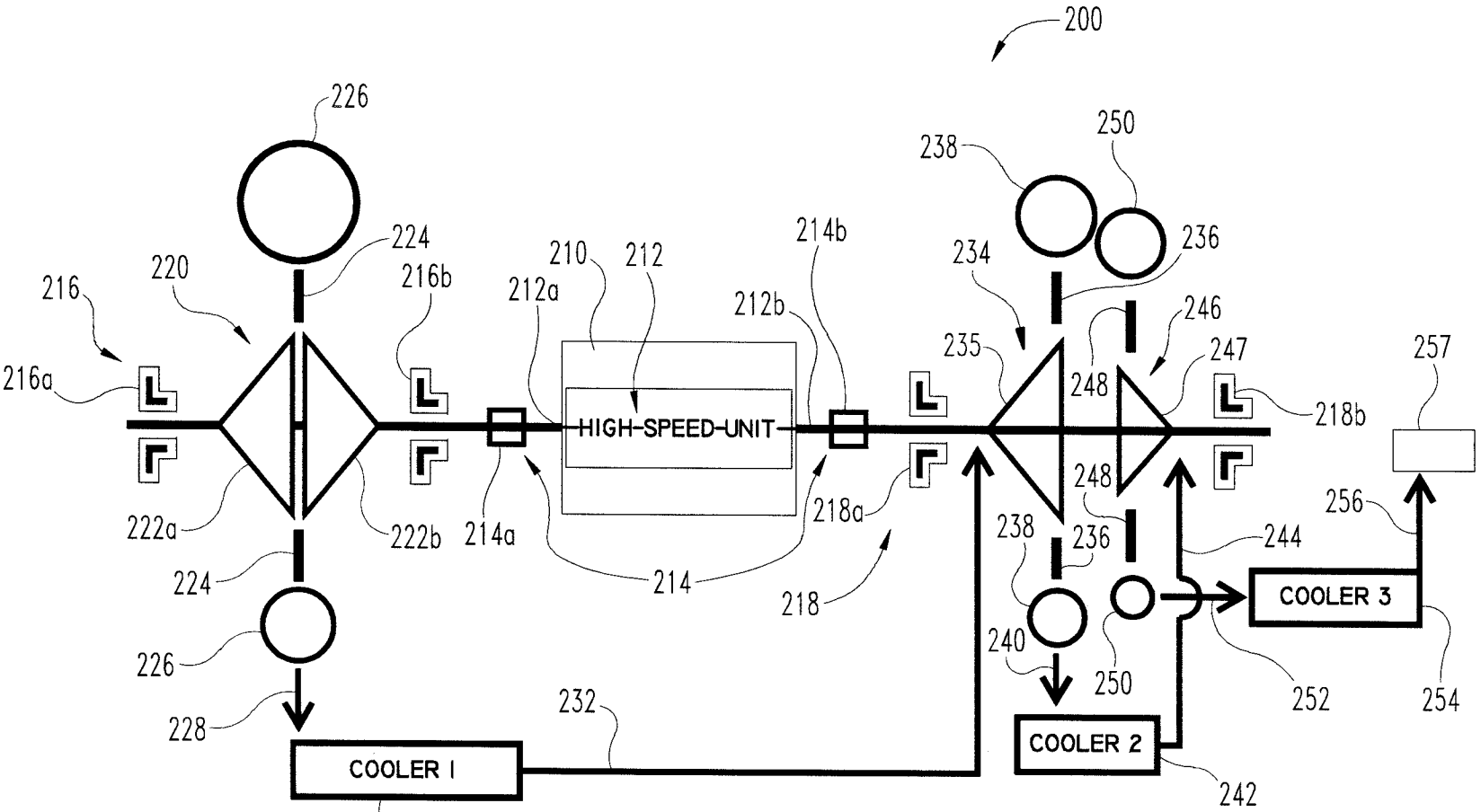
FIG. 2 is a schematic view of a compressor system according to one embodiment of the presented disclosure.

Referring now to FIG. 2, a schematic layout of one exemplary configuration of a compressor system 200 is illustrated therein. A single high speed electric motor 210 is illustrated as a motive source for the three stage compressor. The electric motor 210 includes a single output shaft 212 operable for rotating a plurality of compressors at a desired operational speed. One end 212*a* of the single output shaft 212 extends towards one compressor stage and the other end 212*b* extends toward one of the other compressor stages. In this embodiment, the compressor system 200 includes a first stage compressor 220 at one end of the motor 210 with second and third stage compressors 234, 246 respectively at the other end of the motor 210. Other compressor system configurations are contemplated herein and some will be further described below.

A high speed coupling set 214, including a first high speed coupling 214*a* and a second high speed coupling 214*b*, can be positioned on either end of the output shaft 212*a*, 212*b* respectively. The high speed coupling 214 permits rotational torque to be imparted to the compressors at speeds in excess of 30,000 revolutions per minute (RPM). A first set of high speed magnetic bearings 216 including first and second magnetic bearings 216*a*, 216*b* can be operably coupled to one end 212*a* of the output shaft 212. It should be noted that a magnetic bearing set can include fewer than or more than two bearing locations. Another set of magnetic bearings 218 including a first bearing 218*a* and a second bearing 218*b* can be positioned along the other end 212*b* of the output shaft 212. The first magnetic bearing set 216 can be positioned on either side of the first stage compressor 220. The second magnetic bearing set 218 can be positioned such that the first magnetic bearing 218*a* is positioned between the high speed motor 210 and the second stage compressor 234. The second magnetic bearing 218*b* can be positioned adjacent to an outer side of the third stage compressor 246.

In the exemplary embodiment, the first stage compressor 220 can include a split impeller arrangement which includes a first impeller 222*a* and a second impeller 222*b* each receiving ambient air flow through separate inlet conduits (not shown in this figure). Each of the impellers 222*a*, 222*b* compress the ambient air to a desired pressure with approximately one half the flow rate required from the first stage compressor 220. The compressed air then flows into a diffuser 224 to reduce the exit velocity and to efficiently increase the static pressure of the compressed air with minimal pressure loss. The first stage compressed air then enters to a first stage volute 226 from each of the first and second impellers 222*a*, 222*b*. The first stage compressed air is then discharged from the first stage volute 226 through one or more outlet conduits 228 and directed to a first stage aftercooler 230. While a single aftercooler 230 is shown downstream of the first stage compressor stage 220, it should be understood that more than one aftercooler is also contemplated herein and in some embodiments there may be no cooling between the first stage compressor 220 and the second stage compressor 234.

The first stage compressed cooled air exiting the first aftercooler 230 is then transported to a second stage inlet conduit 232 for supplying first stage discharged compressed air to the second stage compressor 234. A second stage impeller 235 of the second stage compressor further compresses the first stage compressed air to a second higher pressure. The second stage compressed air is then transported to a second stage diffuser 236 to again increase the static pressure and reduce the exit velocity of the second stage compressed air. The second stage compressed air is then transported through a second stage volute 238 and out through a second stage output conduit 240 to a second stage aftercooler 242. The second stage aftercooler 242 cools the discharge air to a desired temperature while minimizing pressure loss. The second stage compressed air is then delivered to a third stage inlet conduit 244 operably connected to a the third stage compressor 246. A third stage impeller 247 similar to the other compressor stages will further compress the air to a final desired pressure which is then transported to a third stage diffuser 248 and a third stage volute 250. A third stage outlet conduit 252 is connected to the third stage volute 250 and is operable for transporting the pressurized air to a third aftercooler 254 to reduce the temperature to a final desired temperature wherein the compressed air is then directed through a delivery conduit 256 to a compressed air holding tank 257 or the like.

Figure 3:
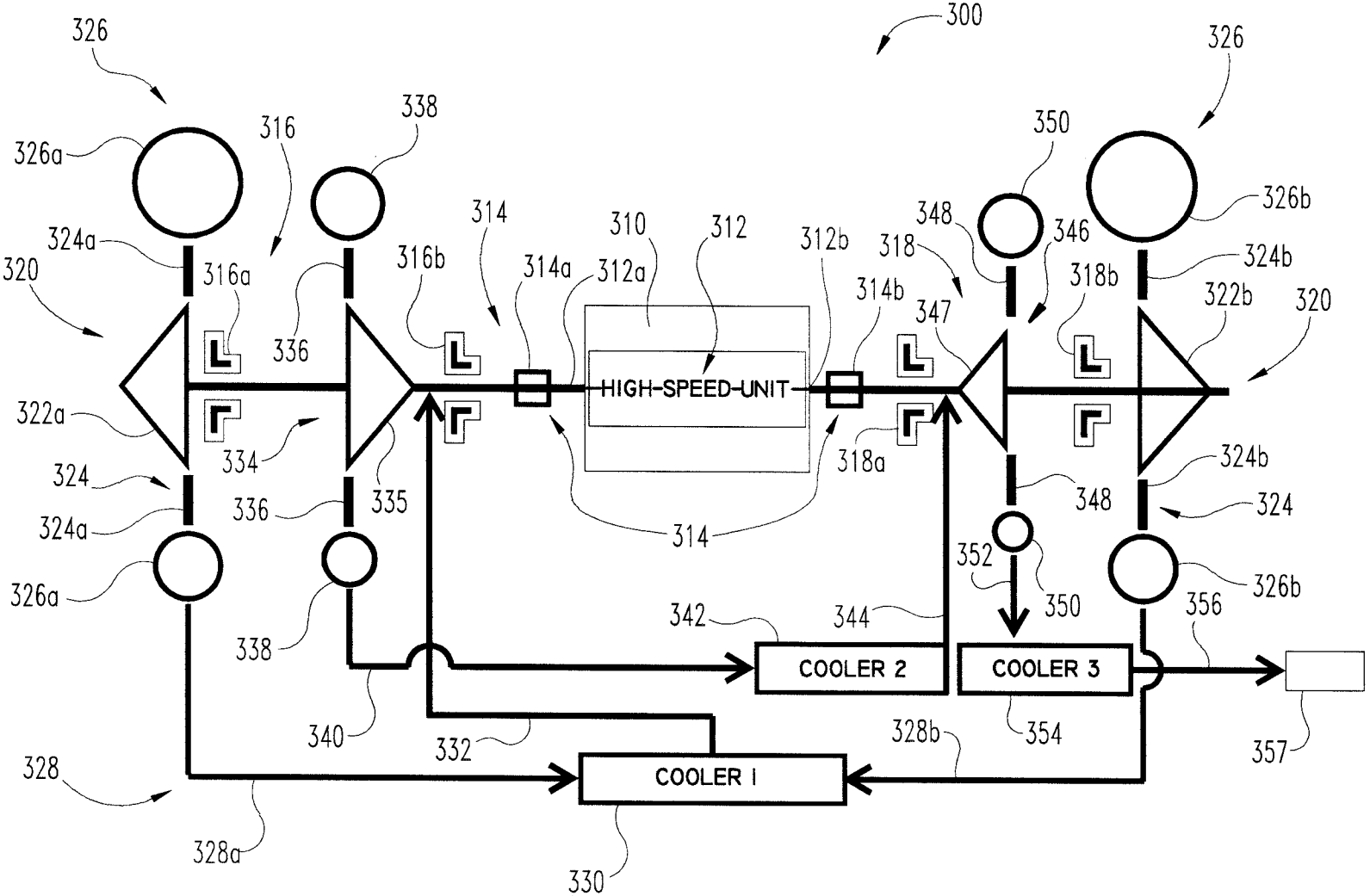
FIG. 3 is a schematic view of a compressor system according to another embodiment of the present disclosure.

Referring now to FIG. 3, a schematic layout of a compressor system 300 is illustrated in an alternate configuration. A single high speed electric motor 310 is illustrated as a motive source for the three stage compressor. The electric motor 310 includes a single output shaft 312 operable for rotating the three stage compressors at a desired operational speed. One end 312*a* of the single output shaft 312 extends toward one compressor stage and the other end 312*b* extends toward one of the other compressor stages. A high speed coupling set 314 can include a first high speed coupling 314*a* and a second high speed coupling 314*b* operably coupled to either end of the output shaft 312*a*, 312*b* respectively. The high speed couplings 314*a*, 314*b* are rotatably connected to a fixed or static structure in the compressor housing (not shown in this figure). A first set of high speed magnetic bearings 316 including first and second magnetic bearings 316*a*, 316*b* can be operably coupled to the output shaft along one end 312*a* of the output shaft 312. Another set of magnetic bearings 318 includes a first 318*a* and a second 318*b* magnetic bearing positioned along the output shaft 314*b*. Magnetic bearing 316*a* can be positioned between two compressor stages 320 and 324. Magnetic bearing 316*b* can be positioned between the electric motor 310 and the second stage compressor 334. Magnetic bearing 318*a* can be positioned between the electric motor 310 and the third stage compressor 346. Magnetic bearing 318*b* can be positioned between the third stage compressor 346 and second impeller 322*b* of the split first stage compressor 320.

In the exemplary embodiment the first stage compressor 320 can include a split first impeller 322*a* and a second split impeller 322*b* with each receiving ambient air flow from conduits that are not shown in this figure. Each of the impellers 322*a*, 322*b* is positioned at opposite ends of the motor 310 and is configured to compress the ambient air to a desired pressure and deliver the compressed air into a diffuser 324 split between diffusers 324*a* and 324*b* so as to effectively increase the static pressure of the compressed air. The first stage compressed air is then delivered to a first stage volute 326 split between volutes 326*a* and 326*b* from each of the first and second impellers 322*a*, 322*b*. The first stage compressed air is then transported from the first stage volute 326 through one or more outlet conduits 328 (split between conduits 328*a* and 328*b*) and then directed to a first stage aftercooler 330.

While a single aftercooler is shown as associated with the first stage compressor stage 320, it should be understood that more than one aftercooler is contemplated in certain embodiments as well as the option of no cooling between the first stage and second stage compressors in other embodiments. The compressed cooled air exiting the first aftercooler 330 is directed to a second stage inlet conduit 332 for supplying compressed air to the second stage impeller 335. The second stage impeller 335 further compresses the first stage compressed air to a desired pressure and is then transported to a second stage diffuser 336 to further increase the static pressure and reduce the exit velocity of the air flow. The second stage compressed air is then transported through a second stage volute 338, out of a second stage output conduit 340 and to a second stage aftercooler 342. The second stage aftercooler cools the air to a desired temperature while maintaining the pressure of the air close to the compressor discharge pressure of the air as defined in the second stage volute 338. Second stage compressed air is then delivered through a third stage inlet conduit 344 that is operably connected to an inlet of the third stage impeller 347. The third stage impeller 347 will further compress the air to a final pressure and discharge the compressed air to a third stage diffuser 348 and subsequently to the third stage volute 350. A third stage outlet conduit 352 is connected to the third stage volute 350 and is operable for transporting the third stage discharge air to a third aftercooler 354 to reduce the temperature to a final desired temperature. The compressed air is then delivered through a delivery conduit 356 to a compressed air holding tank 357 or the like.

Figure 4:
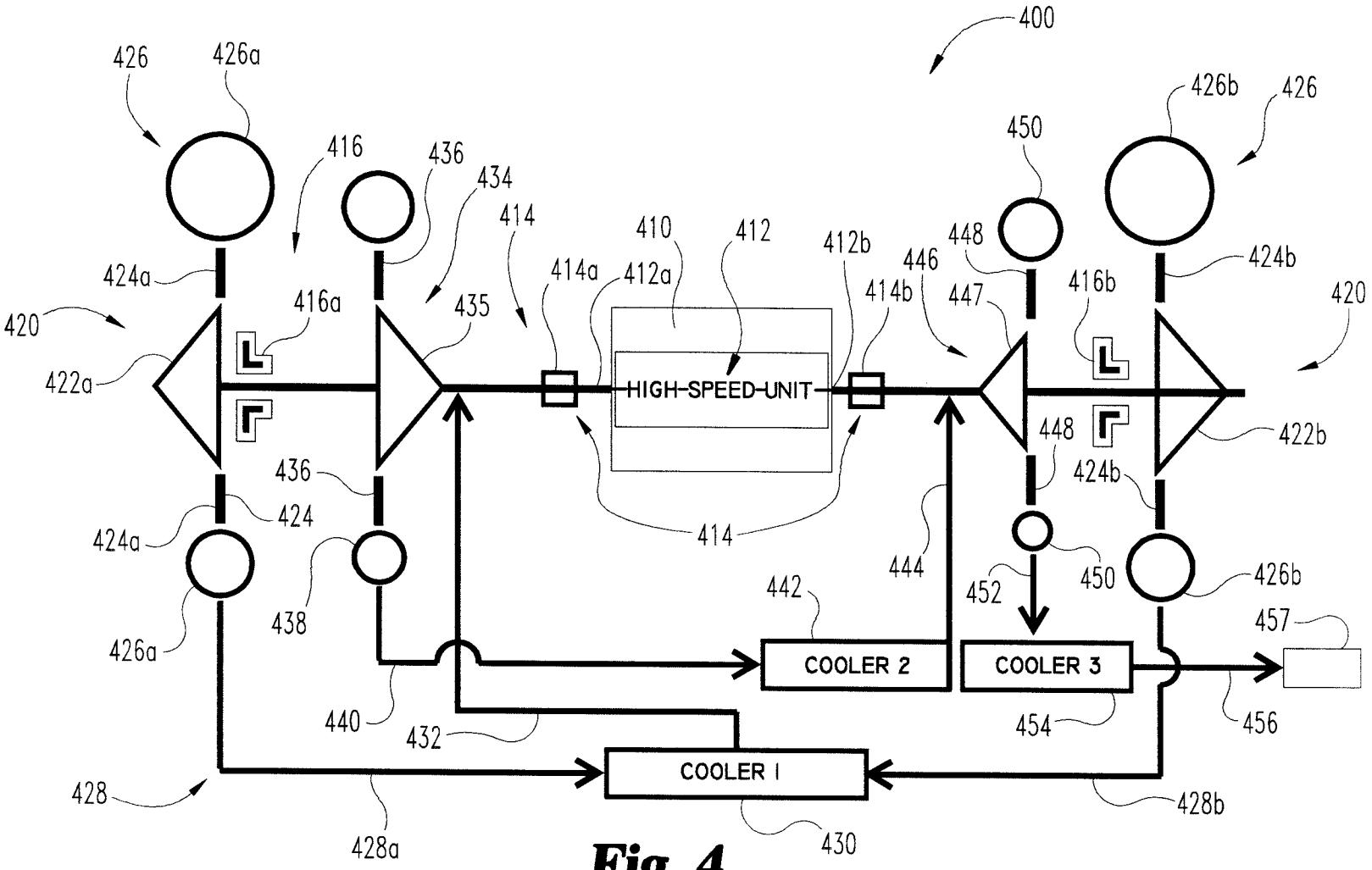
FIG. 4 is a schematic view of a compressor system according to yet another embodiment of the present disclosure.

Referring now to FIG. 4, a schematic layout of an alternate compressor system 400 is illustrated therein. A single high speed electric motor 410 is illustrated as a motive source for the three stage compressor. The electric motor 410 includes a single output shaft 412 operable for rotating the three compressor stages at a desired operational speed. One end 412*a* of the single output shaft 412 extends towards one compressor stage and the other end 412*b* extends toward one of the other two compressor stages. A high speed coupling set 414 can include a first high speed coupling 414*a* and a second high speed coupling 414*b* positioned on either end of the output shaft 412*a*, 412*b* respectively. The high speed couplings are rotatably connected to a fixed or static structure in the compressor housing (not shown in this figure).

In this embodiment a single set of high speed magnetic bearings 416, including first and second magnetic bearings 416*a*, 416*b* are operably coupled to the output shaft at either end 412*a*, 412*b* of the output shaft 412. In this exemplary embodiment a first stage compressor 420 can include a split first impeller 422*a* and second impeller 422*b* each positioned at opposite ends of the electric motor 410. Each of the impellers 422*a*, 422*b* compress the ambient air to a desired pressure ratio and delivers the compressed air into a diffuser 424 split between diffusers 424*a* and 424*b* so as to effectively increase the static pressure of the compressed air. First stage compressed air is then delivered to a first stage volute 426 split between volutes 426*a* and 426*b* from each of the first and second impellers 422*a*, 422*b* respectively. The first stage compressed air is then transported from the first stage volute 426 through a conduit 428 split between conduit 428*a* and conduit 428*b* and then directed to a first stage aftercooler 430.

While a single aftercooler is shown as associated with the first stage compressor stage 420, it should be understood that more than one aftercoolers are also contemplated as well as the possibility that no cooling occurs between the first stage compressor 420 and a second stage compressor 334. The compressed cooled air exiting the aftercooler 430 is directed to a second stage inlet conduit 432 for supplying compressed air to a second stage impeller 435. The second stage impeller 435 further compresses the compressed air to a desired pressure which is then transported to a second stage diffuser 436 to again further increase the static pressure and reduce the exit velocity of the air flow. The second stage compressed air is then transported through a second stage volute 438 and out a second stage output conduit 440 and to a second stage aftercooler 442. The second stage aftercooler cools the air to a desired temperature while minimizing pressure losses of the compressed air. Second stage compressed air is then delivered through a third stage inlet conduit 444 operably connected to an inlet of the third stage impeller 447.

The third stage impeller 447 will further compress the air to a final pressure which then delivers the compressed air to a third stage diffuser 448 prior to entering the third stage volute 450. A third stage outlet conduit 452 is connected to the third stage volute 450 and is operable for transporting the pressurized air to a third aftercooler 454 to reduce the temperature to a desired temperature wherein the compressed air is then delivered through a delivery conduit 456 to a compressed air holding tank 457 or the like.

In one aspect the present disclosure includes a compressor system that is comprised of a single electric motor having first and second ends; a rotatable output shaft extending from the electric motor; first, second and third compressor stages fluidly coupled to one another in series and mechanically connected to the output shaft; and wherein the first compressor stage includes two split impellers with each impeller discharging approximately one half of the fluid flow at a desired pressure to the second compressor stage.

In refined aspects the compress system includes at least one additional compressor stage coupled to the output shaft; wherein the output shaft extends from each of the first and second ends of the electric motor; wherein at least one of the compressor stages is connected to the output shaft extending from the first end of the motor and at least two of the compressor stages are connected to the output shaft extending from the second end of the motor; further comprising an aftercooler in fluid communication with one of the compressor stages; further comprising an aftercooler in downstream fluid communication with each compressor stage; wherein one of the split impellers of the first stage compressor is positioned at one end of the electric motor and the other of the split impellers is positioned at the other end of the electric motor; further comprising an active magnetic bearing operable to rotatably support the output shaft and measure rotor vibration and position; wherein the active magnetic bearing comprises first and second active magnetic bearing coupled to the output shaft between the motor and inner compressor impellers on either side of the motor; and third and fourth active magnetic bearings coupled to the output shaft outward of outer compressor stages positioned outward of the inner compressor impellers on either side of the motor; wherein the active magnetic bearing comprises; first and second active magnetic bearings coupled the output shaft between the motor and inner compressor impellers on either side of the motor; and third and fourth active magnetic bearings positioned between outer compressor impellers and the inner compressor impellers on either side of the motor; wherein the active magnetic hearing comprises: a single active magnetic bearing set with one magnetic bearing positioned between a first split impeller of the first stage compressor and a second stage impeller on one side of the motor and a second magnetic bearing positioned between a second split impeller of the first stage compressor and a third stage impeller; and an electronic controller and a single frequency converter operably coupled to the electric motor.

In another aspect, the present disclosure includes a compressor system comprising a single electric motor; a rotatable output shaft extending from the electric motor; an active magnetic bearing coupled to the output shaft; a first compressor stage coupled to the output shaft; a first aftercooler positioned downstream of the first compressor stage; a second compressor stage coupled to the output shaft positioned downstream of the first aftercooler; a second aftercooler positioned downstream of the second compressor stage; a third compressor stage coupled to the output shaft positioned downstream of the second aftercooler; a third aftercooler positioned downstream of the third compressor stage; wherein the first compressor stage includes a pair of split impellers such that each of the split impellers compress approximately one half of the fluid flow to a desired pressure in the first compressor stage.

In refined aspects, the compressor system is further comprises at least one additional compressor stage coupled to the output shaft; wherein the output shaft extends from each of the first and second ends of the motor and at least one of the compressor stages is connected to the first end of the output shaft and at least two of the compressor stages is connected to the second end of the output shaft; wherein one of the split impellers is positioned at one end of the electric motor and the other of the split impellers is positioned at the other end of the electric motor; wherein the active magnetic bearing includes first and second magnetic bearings coupled the output shaft between the motor and a compressor impeller on either side of the motor; and third and fourth magnetic bearings coupled to the output shaft outward of outer compressor impellers on either side of the motor; wherein the active magnetic bearing includes first and second magnetic bearings coupled the output shaft between the motor and a compressor impeller on either side of the motor; third and fourth magnetic bearings positioned between compressor impellers on either side of the motor; wherein the active magnetic bearing includes a single magnetic bearing set with one magnetic bearing positioned between a first split impeller of the first stage compressor and a second stage impeller on one side of the motor and a second magnetic bearing positioned between a second split impeller of the first stage compressor and a third stage compressor impeller; further comprising a controller operably coupled to the electric motor and the active magnetic bearings; further compromising a single frequency convertor operably coupled to the motor; wherein the active magnetic bearing measures vibration and position of the output shaft; and wherein the motor operates above a first bending critical speed of a rotor.

In yet another aspect, the present disclosure includes a method comprising compressing a fluid to a first predefined pressure with a first stage compressor; compressing the fluid to a second predefined pressure with a second stage compressor; compressing a fluid to a third predefined pressure with a third stage compressor; cooling the compressed fluid after one of the compressing steps; rotating the first, second and third stage compressors at the same speed with a single electric motor; and splitting the fluid entering the first stage compressor between two impellers.

In refined aspects the method further comprises rotatably supporting an output shaft of the electric motor with at least one active magnetic bearing; measuring and controlling rotor vibration and rotor position with the active magnetic bearing; and controlling operation of the active magnetic bearing and the electric motor with an electronic controller.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," "coupled" and variations thereof are used broadly and encompass both direct and indirect mountings, connections, supports, and couplings. Further, "connected" and "coupled" are not restricted to physical or mechanical connections or couplings.

What is claimed is:

1. A compressor system comprising:

a single electric motor having first and second ends;

a rotatable output shaft extending from the electric motor;

first, second and third compressor stages fluidly coupled to one another in series and mechanically connected to the output shaft, each of the first, second, and third compressor stages having a diffuser and outlet volute structured to receive a flow of compressed fluid; and wherein the first compressor stage includes a first split impeller having a first fluid inlet and a second split impeller having a second fluid inlet, the first and the second fluid inlets being in fluid communication with a single source, the first and the second split impellers each discharging approximately one half of the fluid flow at a desired pressure to the second compressor stage; and wherein the third compressor stage includes a third stage impeller, the second compressor stage includes a second stage impeller, wherein the third compressor stage is structured to receive the flow from the second compressor stage, and wherein the third stage impeller is smaller than the second stage impeller.

2. The compressor system of claim 1, further comprising at least one additional compressor stage coupled to the output shaft.

3. The compressor system of claim 1, wherein the output shaft extends from each of the first and second ends of the electric motor.

4. The compressor system of claim 3, wherein at least one of the compressor stages is connected to the output shaft extending from the first end of the motor and at least two of the compressor stages are connected to the output shaft extending from the second end of the motor.

5. The compressor system of claim 1, further comprising an aftercooler in downstream fluid communication with one of the compressor stages.

6. The compressor system of claim 1, further comprising an aftercooler in downstream fluid communication with each compressor stage.

7. The compressor system of claim 1, further comprising an active magnetic bearing operable to rotatably support the output shaft and measure rotor vibration and position.

8. The compressor system of claim 7, wherein the active magnetic bearing further comprises:

first and second active magnetic bearings coupled to the output shaft between the motor and inner compressor impellers on either side of the of the motor; and third and fourth active magnetic bearings coupled to the output shaft outward of outer compressor stages positioned outward of the inner compressor impellers on either side of the motor.

9. The compressor system of claim 1, further comprising an electronic controller and a single frequency converter operably coupled to the electric motor.

10. The compressor system of claim 1, wherein the second compressor stage includes a single impeller, wherein the second stage impeller is the single impeller of the second compressor stage, wherein the third compressor stage includes a single impeller, and wherein the third stage impeller is the single impeller of the third compressor stage.

11. A compressor system comprising:

an electric motor;

a rotatable output shaft extending from the electric motor;

an active magnetic bearing coupled to the output shaft;

a first compressor stage coupled to the output shaft;

a first aftercooler positioned downstream of the first compressor stage;

a second compressor stage coupled to the output shaft positioned downstream of the first aftercooler;

a second aftercooler positioned downstream of the second compressor stage;

a third compressor stage coupled to the output shaft positioned downstream of the second aftercooler;

a third aftercooler positioned downstream of the third compressor stage;

wherein the first compressor stage includes a first split impeller having a first fluid inlet and a second split impeller having a second fluid inlet, the first and the second fluid inlets being in fluid communication with a single source, the first and the second split impellers each compressing approximately one half of the fluid flow to a desired pressure in the first compressor stage;

wherein the first compressor stage includes a diffuser and outlet volute, the second compressor stage includes a diffuser and outlet volute, and the third compressor stage includes a diffuser and outlet volute; and wherein the third compressor stage includes a third stage impeller, the second compressor stage includes a second stage impeller, wherein the third compressor stage is structured to receive the flow from the second compressor stage, and wherein the third stage impeller is smaller than the second stage impeller.

12. The compressor system of claim 11, further comprising at least one additional compressor stage coupled to the output shaft.

13. The compressor system of claim 11, wherein the output shaft extends from each of the first and second ends of the motor and at least one of the compressor stages is connected to the first end of the output shaft and at least two of the compressor stages are connected to the second end of the output shaft.

14. The compressor system of claim 11, wherein the active magnetic bearing includes:

first and second magnetic bearings coupled to the output shaft between the motor and a compressor impeller on either side of the of the motor; and third and fourth magnetic bearings coupled to the output shaft outward of outer compressor impellers on either side of the motor.

15. The compressor system of claim 11, further comprising a controller operably coupled to the electric motor and the active magnetic bearings.

16. The compressor system of claim 11, further comprising a single frequency convertor operably coupled to the motor.

17. The compressor system of claim 11, wherein the active magnetic bearing measures vibration and position of the output shaft.

18. The compressor system of claim 11, wherein the motor operates above a first bending critical speed of a rotor.

19. The compressor system of claim 11, wherein the second compressor stage includes a single impeller, wherein the second stage impeller is the single impeller of the second compressor stage, wherein the third compressor stage includes a single impeller, and wherein the third stage impeller is the single impeller of the third compressor stage.

20. A method comprising:

compressing a fluid to a first predefined pressure with a first stage compressor;

discharging the fluid from the first stage compressor into a first stage diffuser and first stage volute;

compressing the fluid to a second predefined pressure with a second stage compressor;

discharging the fluid from the second stage compressor into a second stage diffuser and second stage volute;

compressing a fluid to a third predefined pressure with a third stage compressor, wherein the compressing the fluid to a third predefined pressure includes flowing the fluid through an impeller of the third stage compressor which is smaller than an impeller of the second stage compressor;

discharging the fluid from the third stage compressor into a third stage diffuser and third stage volute;

cooling the compressed fluid after one of the compressing steps;

rotating the first, second and third stage compressors at the same speed with a single electric motor; and splitting the fluid entering the first stage compressor between a first split impeller having a first fluid inlet and a second split impeller having a second fluid inlet, each of the first and the second fluid inlets being in fluid communication with a single source.

21. The method of claim 20 further comprising rotatably supporting an output shaft of the electric motor with at least one active magnetic bearing.

22. The method of claim 21 further comprising measuring and controlling rotor vibration and rotor position with the active magnetic bearing.

23. The method of claim 21 further comprising controlling operation of the active magnetic bearing and the electric motor with an electronic controller.

24. The method of claim 20, wherein the rotating speed of the electric motor is set such that the operating efficiency of the second stage compressor is maximized.

* * * * *